US007156610B2

(12) United States Patent
Jang et al.

(10) Patent No.: US 7,156,610 B2
(45) Date of Patent: Jan. 2, 2007

(54) TURBINE TYPE ELECTRIC FUEL PUMP FOR AUTOMOBILE

(75) Inventors: Jin Wook Jang, Seoul (KR); Sang Jun Park, Gongju (KR); Sang Chul Noh, Seosan (KR); Yong Taek Hwang, Cheonan (KR)

(73) Assignee: Hyundam Industrial Co., Ltd., Asan (KR)

( * ) Notice: Subject to any disclaimer, the term of this patent is extended or adjusted under 35 U.S.C. 154(b) by 81 days.

(21) Appl. No.: 10/896,499

(22) Filed: Jul. 22, 2004

(65) Prior Publication Data

US 2005/0025616 A1 Feb. 3, 2005

(30) Foreign Application Priority Data

Jul. 28, 2003 (KR) ..... 10-2003-0052078

(51) Int. Cl.
*F04D 5/00* (2006.01)

(52) U.S. Cl. ..... 415/55.1; 417/423.1

(58) Field of Classification Search ..... 415/55.1–55.7; 417/423.1–42, 423.5, 423.7, 423.11, 423.2
See application file for complete search history.

(56) References Cited

U.S. PATENT DOCUMENTS 6,102,653 A 8/2000 Marx
6,152,688 A * 11/2000 Staab et al. ..... 415/55.5
6,231,300 B1 * 5/2001 Wilhelm et al. ..... 415/55.1
6,309,173 B1 * 10/2001 Marx ..... 415/55.1
6,540,474 B1 * 4/2003 Marx et al. ..... 415/55.1

FOREIGN PATENT DOCUMENTS

DE 19943261 A1 * 3/2001
JP 2002-285986 10/2002
JP 2003-155992 5/2003

* cited by examiner

*Primary Examiner*—Igor Kershteyn
(74) *Attorney, Agent, or Firm*—Morgan & Finnegan, L.L.P.

(57) ABSTRACT

Provided is a turbine type electric fuel pump for an automobile having a casing in which a pump portion and a motor portion are installed. The pump portion includes a fuel intake case having a fuel intake hole, a fuel discharge case having a fuel discharge hole, and an impeller installed on a pumping chamber. An inlet side ring type duct is connected to the fuel intake hole. An outlet side ring type duct is connected to the fuel discharge hole. The impeller includes a disc portion in which a shaft assembly portion is formed at the center thereof, a plurality of blades extending from an outer circumferential surface of the disc portion outwardly in a radial direction, and a ring portion connecting the blades along the outer circumferential surface of the disc portion. The outer circumferential surface of the disc portion gradually protrudes outwardly in a radial direction of the impeller from both upper and lower sides thereof to a center thereof. The inner circumferential surface of the ring portion gradually protrudes inwardly in a radial direction of the impeller from both upper and lower sides thereof to a center thereof.

3 Claims, 10 Drawing Sheets

PRIOR ART

PRIOR ART

PRIOR ART

PRIOR ART

PRIOR ART

TURBINE TYPE ELECTRIC FUEL PUMP FOR AUTOMOBILE

BACKGROUND OF THE INVENTION

This application claims the priority of Korean Patent Application No. 2003-52078, filed on Jul. 28, 2003, in the Korean Intellectual Property Office, the disclosure of which is incorporated herein in its entirety by reference.

1. Field of the Invention

The present invention relates to a turbine type electric fuel pump for an automobile, and more particularly, to a turbine type electric fuel pump for an automobile in which the shapes of an impeller and other parts are improved to reduce loss of pressure due to a collision flow in the fuel pump that is installed in a fuel tank of the automobile and deliver fuel to an engine by the rotation of the impeller.

2. Description of the Related Art

A fuel pump for sucking fuel from a fuel tank and delivering the fuel at pressure to a vaporizer or a fuel injector is one of important parts in an automobile. The fuel pump is classified as a mechanical type and an electric type according to the type of driving a pump mechanism. Among these, a turbine type electric fuel pump, which is a sort of the electric fuel pump, is most used recently and consists of a DC motor portion and a turbine type pump portion. When a DC motor rotates, an impeller is rotated to generate a lift force so that a difference in pressure is generated and fuel is sucked in the impeller. Then, the pressure of fuel increases by a vortex flow generated by the continuous rotation of the impeller so that the fuel is discharged out of the pump.

The impeller used in the conventional turbine type electric fuel pump can be classified as a peripheral type or a side channel type. The peripheral type impeller has a plurality of radial blades provided at an edge of the impeller. The side-channel type impeller has a side ring connecting end tips of the blades that is added to the peripheral type impeller.

Referring to FIGS. 1A through 1E, the structure and operation of a conventional side ring type turbine type electric fuel pump 1 for an automobile are described. FIG. 1A is a cross-sectional view of a conventional side ring type fuel pump. FIG. 1B is a perspective view of the fuel intake case of FIG. 1A. FIG. 1C is an exploded perspective view of a fuel intake case 21, an impeller 23, and a fuel discharge case 22. FIGS. 1D and 1E are cross-sectional views of the pump portion of FIG. 1A, which schematically show the flow of fluid in the pump case.

Referring to FIG. 1A, a turbine type electric fuel pump 1 for an automobile has a pump portion 2 and a motor portion 3 which are included in a casing 4. The motor portion 3 includes a rotor 32 rotatably supported by a drive shaft 37 in the casing 4, a permanent magnet 33 installed on an inner surface of the casing 4 to encompass the rotor 32 by being separated a predetermined gap from the rotor 32, a rectifier 34 protruding from an end portion of the rotor 32, and a brush 35 intermittently contacting the rectifier 34 to provide electricity from an electric socket 5*d* provided at a portion of a pump upper surface cover 5 to the rectifier 34.

The pump portion 2 includes the fuel intake case 21 sucking fuel in a lower end portion of the casing 4, the impeller 23, and a fuel discharge case 22. The impeller 23 includes a disc portion 231 that is thin, a plurality of blades 234 radially formed at an edge of the disc portion 231, and a ring portion 233 connecting the blades 234. The impeller 23 is inserted in a pumping chamber that is encompassed by a circular edge 22*b* protruding along the edge of the fuel discharge case 22, so that the ring portion 233 is in contact with an annular inner ledge 22*f* (refer to FIG. 1C). Blades chambers 253 and 254 are formed between the blades 234 of the impeller 23 (refer to FIGS. 1D and 1E).

The drive shaft 37 coupled to the center of the rotor 32 of the motor portion 3 penetrates shaft assembly portions 22*b* and 232 of the fuel discharge case 22 and the impeller 23 and is supported by a shaft support pin 21*f* inserted in a shaft support portion 21*b* of the fuel intake case 21. When electricity supplied to the electric socket 5*d* is supplied to the rectifier 34 via a brush 35, the rotor 32 rotates by an electromagnetic operation of the coil 32*a* and the permanent magnet 33. Accordingly, the impeller 23 connected by the rotor 32 and the drive shaft 37 are rotated.

Reference numeral 5*b* of FIG. 1A denotes a check valve including a check ball 5*b*' and a spring 5*b*". When an engine of a car stops, the check valve 5*b* prevents backflow of fuel and maintains a particular remaining pressure in a fuel pump so that the engine can be easily restarted. Reference numeral 5*c* denotes a relief value which operates a valve when the pressure of a fuel line increases abnormally so that the pressure in the fuel pump can be constantly maintained. Reference numerals 36*a* and 36*b* denote bearings supporting the drive shaft 37 at the front and back sides thereof.

Referring to FIGS. 1B and 1C, a fuel intake hole 21*a* and a fuel discharge hole 22*a* are formed in the fuel intake case 21 and the fuel discharge case 22, respectively, corresponding to positions where the blades 234 of the impeller 23 are formed. An inlet side ring type duct 22*c* and an outlet side ring type duct 22*c* are symmetrically formed at inner surfaces 21*d* and 22*d* of the fuel intake case 21 and the fuel discharge case 22, respectively. An end portion 22*e* of the outlet side ring type duct 22*c* is formed at the opposite side of the fuel intake hole 21*a* of the inlet side ring type duct 21*c*. An end portion 22*e* of the outlet side ring type duct 22*c* is formed at the opposite side of the fuel intake hole 21*a* of the inlet side ring type duct 21*c*. The fuel discharge hole 22*a* of the outlet side ring type duct 22*c* is formed at the opposite side of the end portion 21*e* of the inlet side ring type duct 21*c*.

FIGS. 1D and 1E are sectional views of the pump portion 2 of FIG. 1A. In FIGS. 1D and 1E, the flow of fluid generated when fuel is sucked in through the fuel intake hole 21*a* by rotation of the impeller 23 and discharged through the fuel discharge hole 22*a* after circulating within the pump is schematically illustrated.

Semicircular sectional portions of the inlet side ring type duct 21*c* and the outlet side ring type duct 22*c* form an inlet side transfer chamber 251 and an outlet side transfer chamber 252, respectively. A space between the blades 234 of the impeller 23 is divided into two blade chambers 253 and 254 by a portion sharply protruding along a center line of an outer portion of the disc portion 231. The inlet side transfer chamber 251, the outlet side transfer chamber 252, the inlet side blade chamber 253, and the outlet side blade chamber 254 forms a connection path 25 connecting the fuel intake hole 21*a* and the fuel discharge hole 22*a*. After entering through the fuel intake hole 21*a*, the fuel circulates around the impeller 23 along the connection path 25 and forms circular vortex flows VF each rotating in the opposite direction in the connection path 25. A portion of the vortex flow of the inlet side transfer chamber 251 and the inlet side blade chamber 253 are moved to the vortex flow in the outlet side transfer chamber 252 and the outlet side blade chamber 254.

However, since the inner circumferential surface of the ring portion 233 of the impeller 23 shown in FIG. 1D, is flat, a collision flow CF which collides against the rotation direction of the fluid in the blade chambers 253 and 254 exists so that loss of pressure in the pump occurs. To reduce the counter flow of the fluid in the pump, a structure of the impeller 23 as shown in FIG. 1E, in which a round shape is applied to the inner circumferential surface of the ring portion 233 of the impeller 23 such that the inner circumferential surface protrudes inwardly in a radial direction of the impeller 23 from both upper and lower ends to a center line CL, has been suggested. However, in the case of the impeller 23 of FIG. 1E, although the collision flow directly colliding against the inner circumferential surface of the ring portion 233 may decrease, loss of pressure occurs due to the collision flow CF generated when two vortex flows VF collide at the center line CL.

As a result, when the loss of pressure is generated due to the collision between the fluids, the fluid amount performance and efficiency of the pump is deteriorated so that fuel cannot be sufficiently supplied to an engine. When the initial rotation number of a fuel pump is set to be high in consideration of the pressure loss at the stage of designing a car, noise and vibration due to the operation of the fuel pump increase. Thus, passengers desiring quite driving is inconvenienced by the noise and vibration. Furthermore, the life span of the fuel pump is reduced.

SUMMARY OF THE INVENTION

To solve the above and/or other problems, the present invention provides a turbine type electric fuel pump for an automobile in which the generation of a collision flow in a fuel pump is prevented by improving the shape of parts such as blades of an impeller, a fuel intake case, and a fuel discharge case. Thus, loss of pressure is remarkably reduced and noise and vibration due to the operation of the fuel pump are reduced so that quiet driving is possible and the life span of the fuel pump is extended.

According to an aspect of the present invention, a turbine type electric fuel pump for an automobile has a casing in which a pump portion and a motor portion are installed, wherein the pump portion comprises a fuel intake case forming a lower end portion of the casing and having a fuel intake hole formed therein a fuel discharge case forming a pumping chamber by contacting an inner surface of the fuel intake case in the casing and having a fuel discharge hole formed therein, and an impeller installed on the pumping chamber, wherein an inlet side ring type duct connected to the fuel intake hole is formed on the inner surface of the fuel intake case to have a semicircular section structure, and an outlet side ring type duct connected to the fuel discharge hole is formed on an inner surface of the fuel discharge case that faces the fuel intake case to have a semicircular section structure, wherein the impeller comprises a disc portion in which a shaft assembly portion is formed at the center thereof, a plurality of blades extending from an outer circumferential surface of the disc portion outwardly in a radial direction, and a ring portion connecting the blades along the outer circumferential surface of the disc portion, wherein the outer circumferential surface of the disc portion gradually protrudes outwardly in a radial direction of the impeller from both upper and lower sides thereof to a center thereof so as to form a first protruding step, and the inner circumferential surface of the ring portion gradually protrudes inwardly in a radial direction of the impeller from both upper and lower sides thereof to a center thereof so as to form a second protruding step, so that a space between the blades has a structure in which two semicircular sections, each being defined by the outer circumferential surface of the disc portion and the inner circumferential surface of the ring portion, do not overlap and are connected each other.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1A:
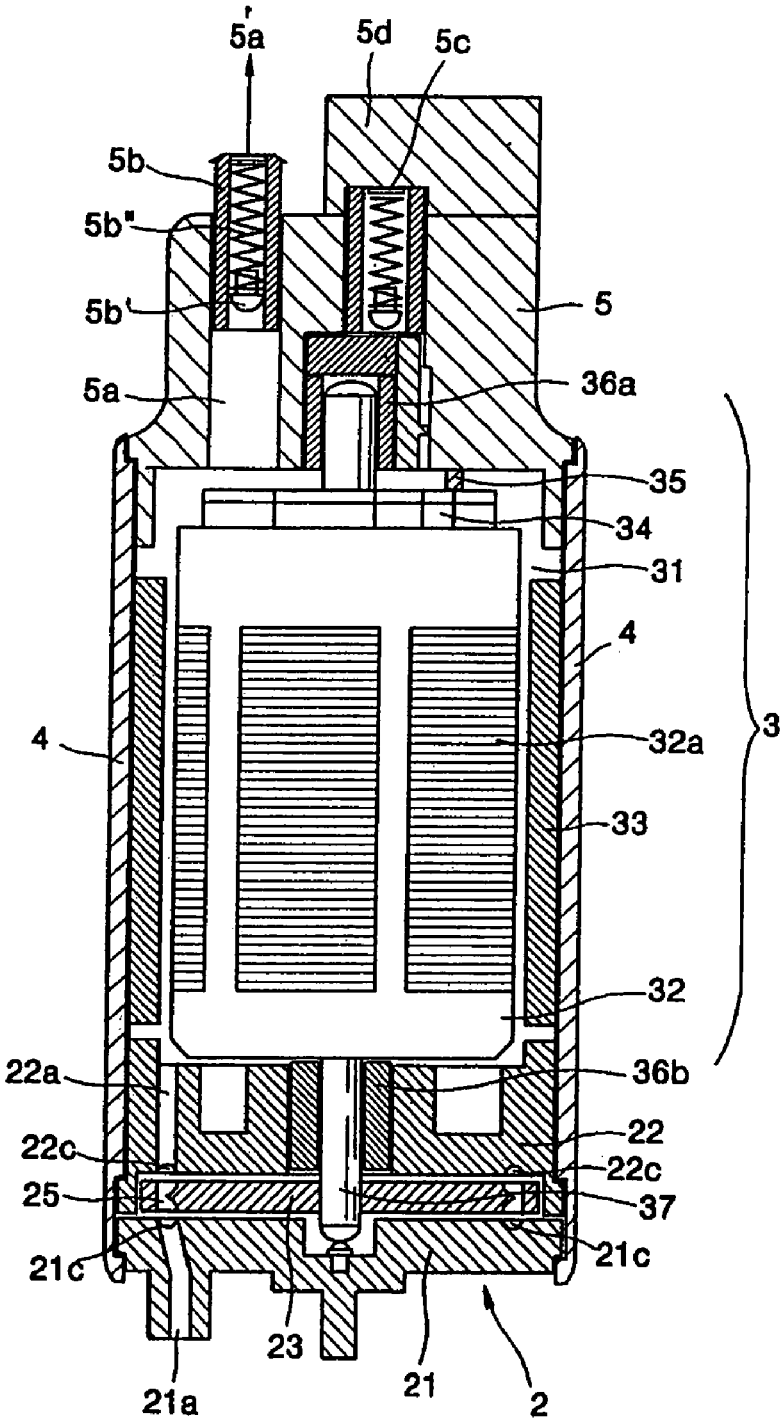
FIG. 1A is a cross-sectional view of a conventional side ring type fuel pump.
Figure 1B:
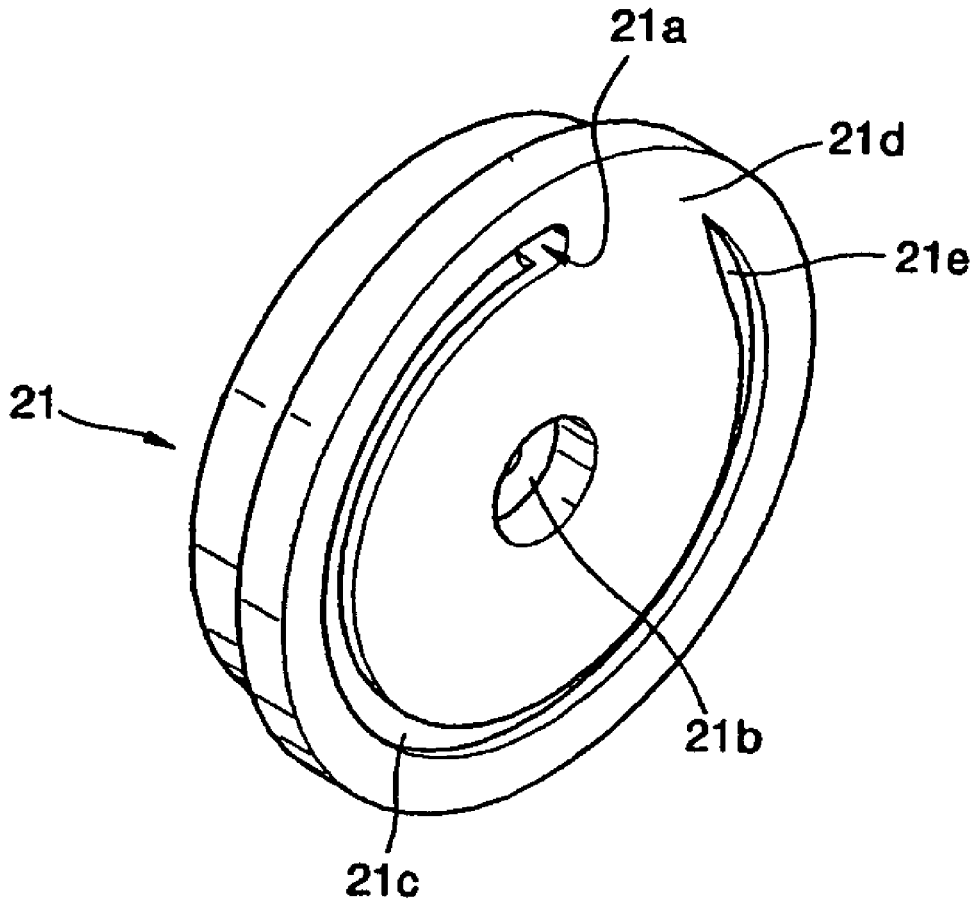
FIG. 1B is a perspective view of the fuel intake case of FIG. 1A.
Figure 1C:
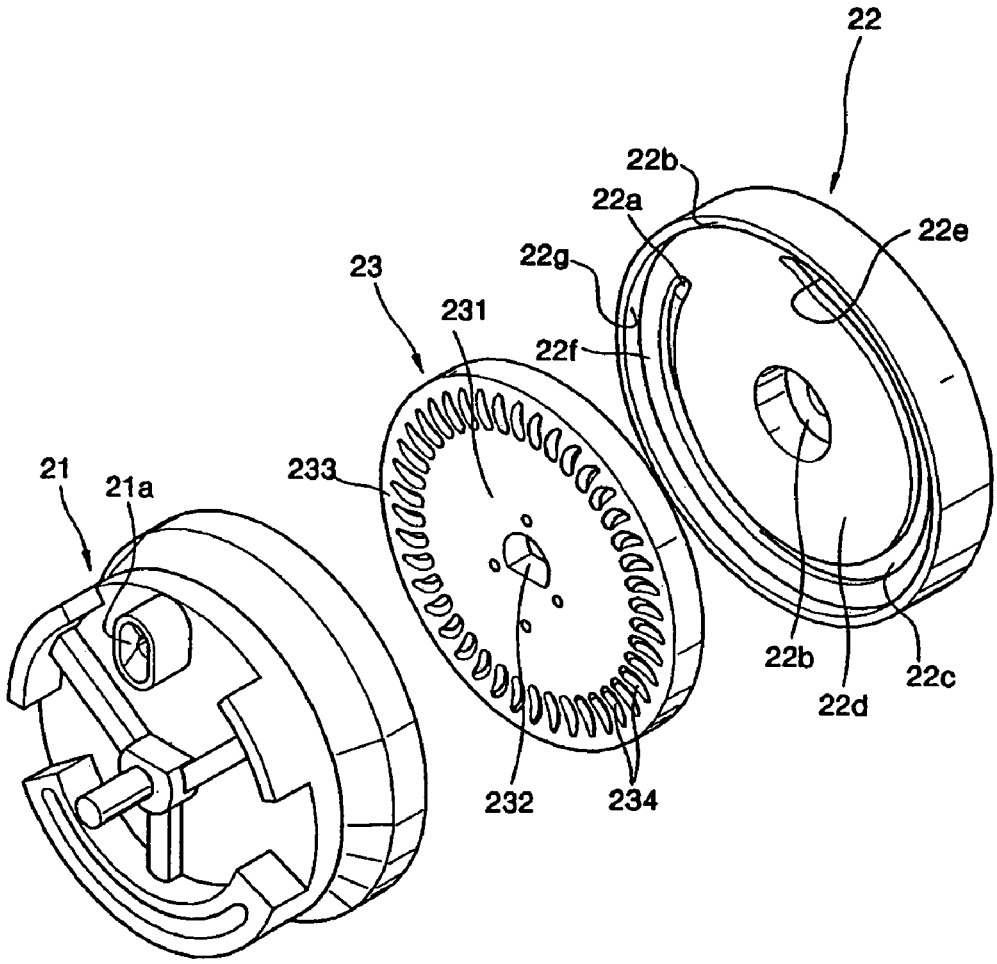
FIG. 1C is an exploded perspective view of the fuel intake case, the impeller, and the fuel discharge case.
Figure 1D:
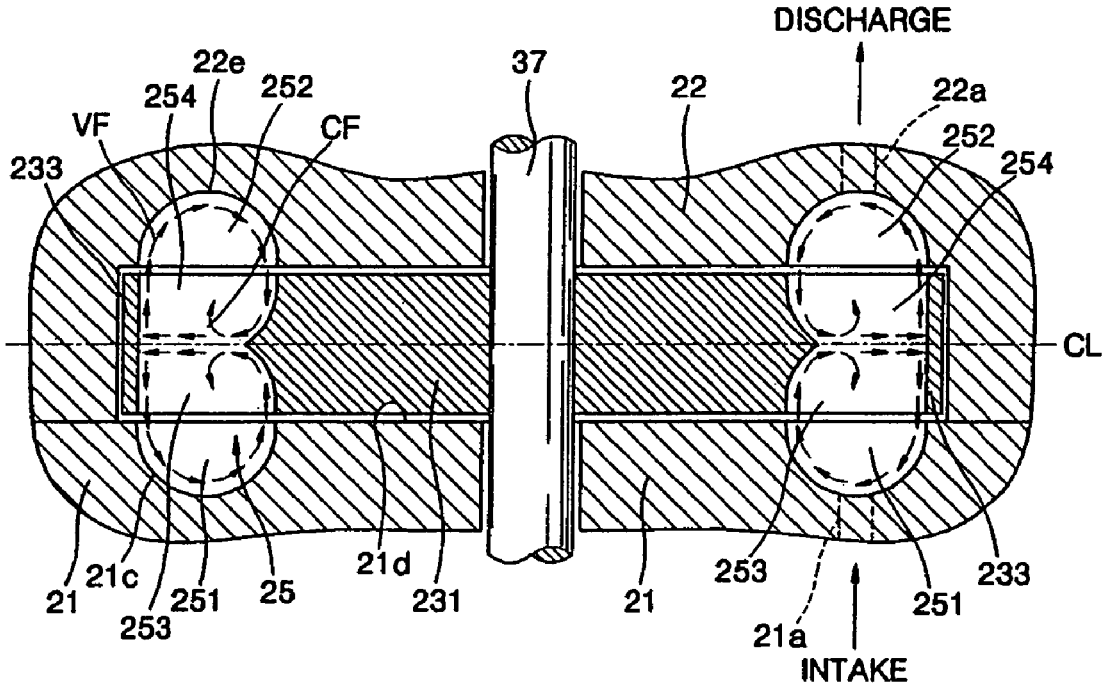
FIGS. 1D and 1E are cross-sectional views of the pump portion of FIG. 1A, which schematically show the flow of fluid in the pump case.
Figure 1E:
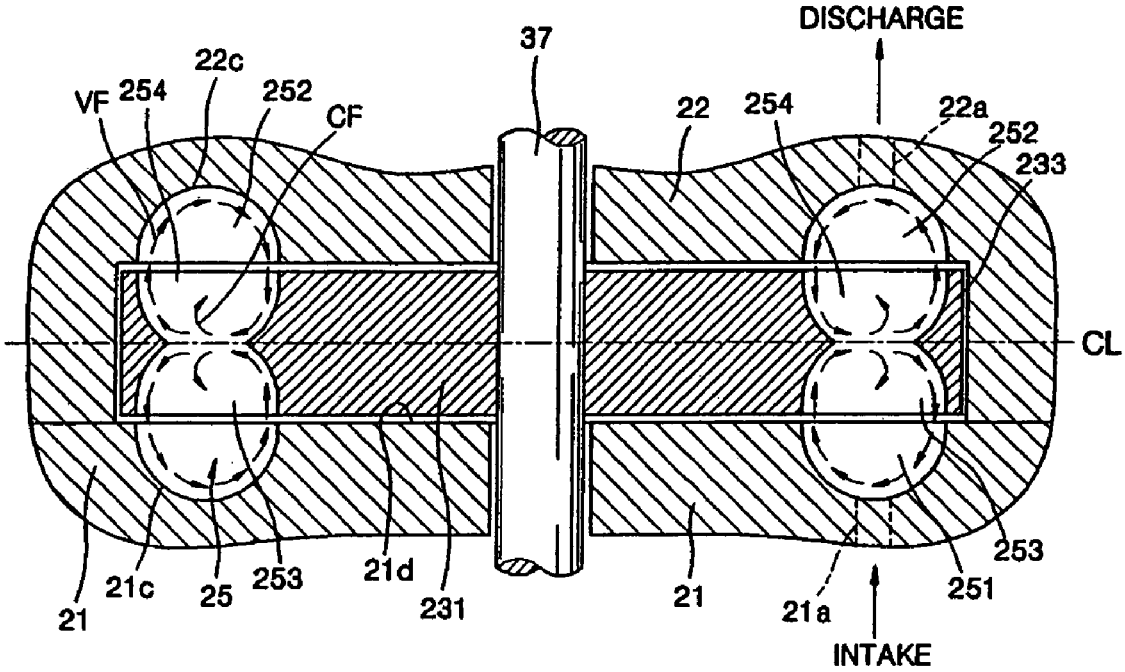

A turbine type electric fuel pump for an automobile according to the present invention in which loss of pressure due to a collision flow in a pump case is reduced is described below with reference to the accompanying drawings. In the following embodiment, the same reference numerals are used for the same elements as those shown in FIGS. 1A through 1E and descriptions thereof are omitted herein.

Figure 2:
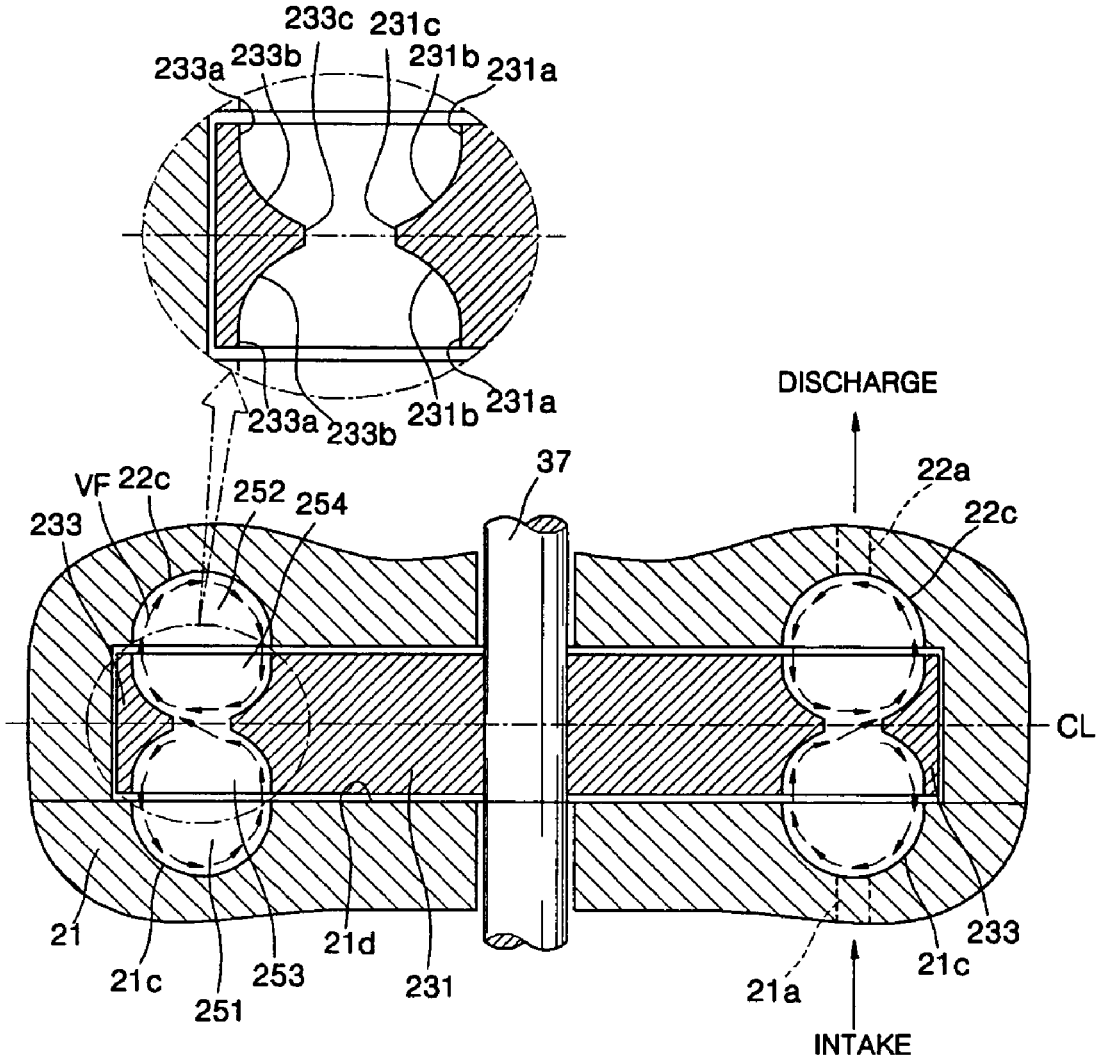
FIG. 2 is a cross-sectional view of a pump portion of a turbine type electric fuel pump for an automobile according to a first embodiment of the present invention.
Figure 3:
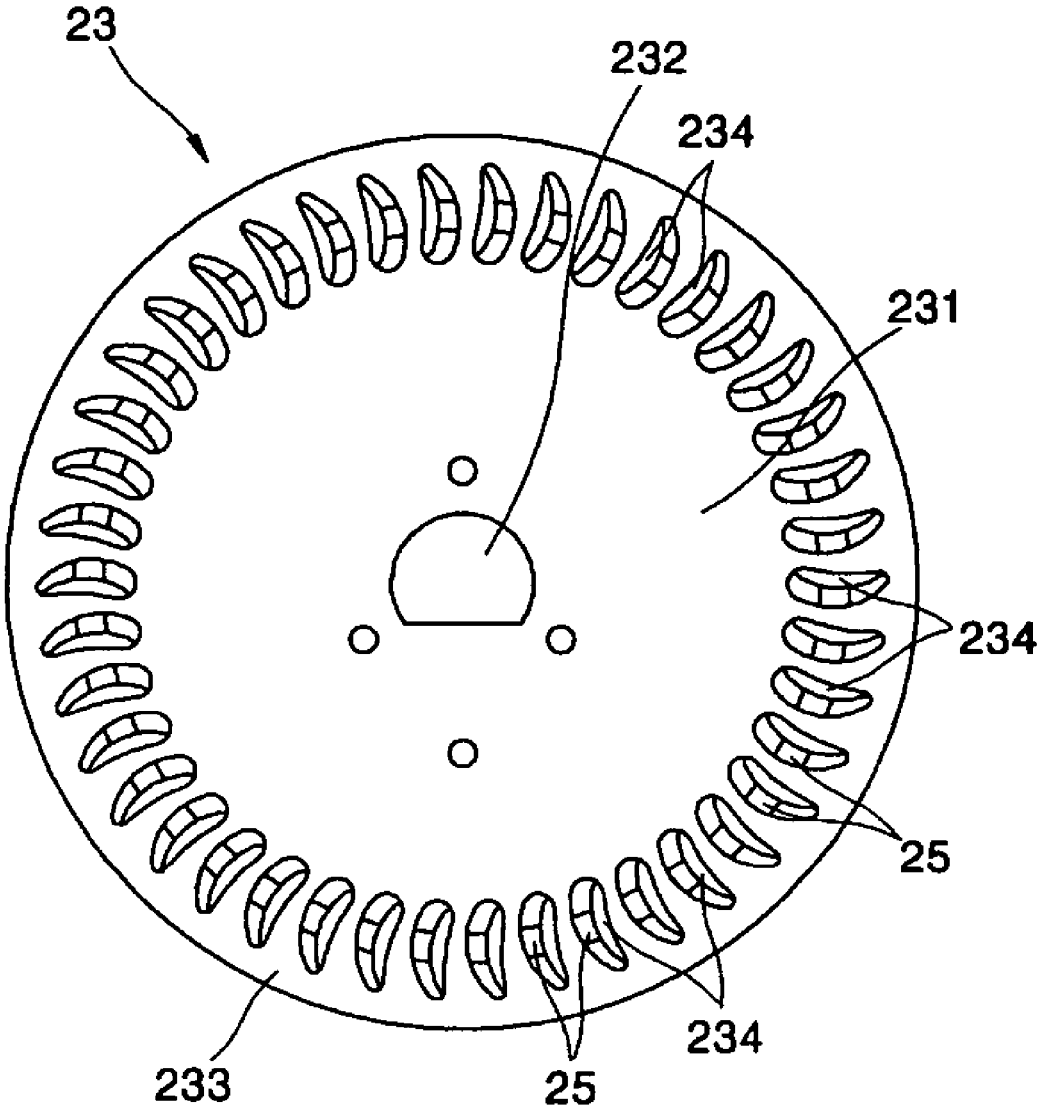
FIG. 3 is a plan view of the impeller of FIG. 2.

FIG. 2 is a cross-sectional view of a pump portion 2 of a turbine type electric fuel pump for an automobile according to a first embodiment of the present invention, showing an improved shape of the impeller 23. FIG. 3 is a plan view of the impeller 23 of FIG. 2.

In the shape of the impeller 23 shown in FIGS. 2 and 3, it is a main characteristic feature that the inner circumferential surface of the ring portion 233 and the outer circumferential surface of the disc portion 231 of the impeller 23 are designed to has a round shape, and protruding steps 233*c* and 231*c* are additionally formed at the center portion thereof, so that semicircular sections formed by the inlet side blade chamber 253 and the outlet side blade chamber 254 do not overlap. In detail, the inner circumferential surface of the ring portion 233 is divided into three parts, that is, a flat surface 233*a*, a curved surface 233*b*, and the protruding step 233*c* from both upper and lower ends thereof to the center thereof. The outer circumferential surface of the disc portion 231 is also divided into three parts, that is, a flat surface 231*a*, a curved surface 231*b*, and the protruding step 231*c* from both upper and lower ends thereof to the center thereof. Accordingly, the inlet side and outlet side blade chambers 253 and 254 do not overlap.

The improved structure of the impeller 23 makes a fluid smoothly flow not directly collide against the inner circumferential surface of the ring portion 233 so that loss of pressure of the fluid in the blade chambers 253 and 254 is reduced. That is, In the conventional impeller, since a tip of the protruding portion formed as the round shape of the blade chambers 253 and 254 overlap is sharp, the collision of the vortex flow between the inlet side blade chamber 253 and the outlet blade chamber 254 cannot be effectively prevented (refer to FIGS. 1D and 1E). In the present invention as shown in FIG. 2, however, since a linear surface exists on the protruding steps 233*c* and 231*c* formed at the inner circumferential surface of the ring portion 233 and the outer circumferential surface of the disc portion 231, both inlet side and outlet side blade chambers 253 and 254 do not overlap so that collision of the fluid in the blade chambers 253 and 254 can be effectively prevented.

Figure 4:
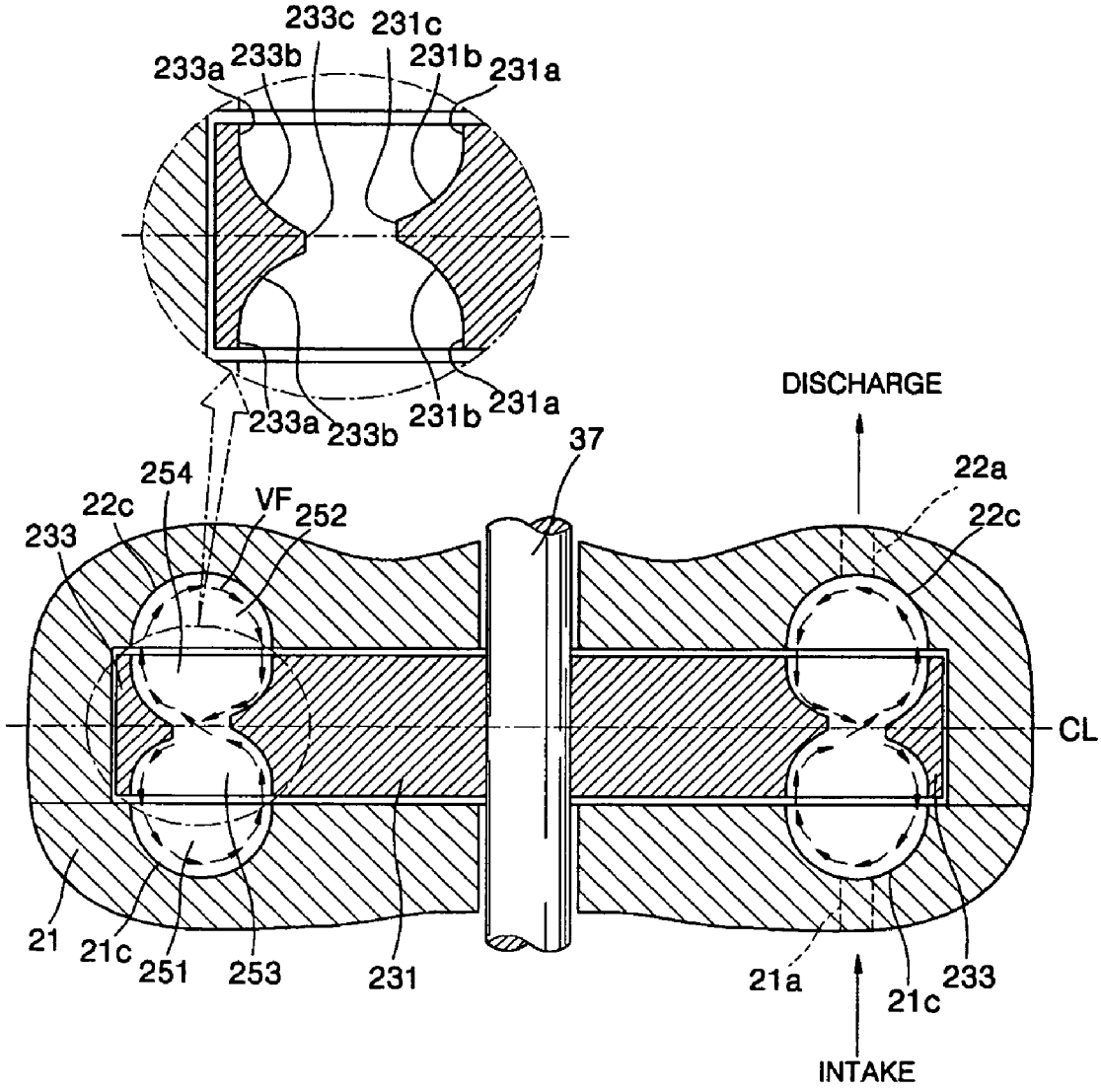
FIG. 4 is a cross-sectional view of a pump portion of a turbine type electric fuel pump for an automobile according to a second embodiment of the present invention.

FIG. 4 is a cross-sectional view of a pump portion of a turbine type electric fuel pump for an automobile according to a second embodiment of the present invention. Referring to FIG. 4, in the present embodiment, the protruding step 231*c* of the disc portion 231 and the protruding step 233*c* of the ring portion 233 are not located on the same center line CL but slightly deviated therefrom, which is different from the first embodiment of the present invention. That is, the protruding step 231*c* of the disc portion 231 is deviated toward the fuel discharge case 22 with respect to the center line CL while the protruding step 233*c* of the ring portion 233 is deviated toward the fuel intake case 21.

When the protruding steps 231*c* and 233*c* of the disc portion 231 and the ring portion 233 are not arranged along the same center line CL but located at positions separated the same distance from the center line CL in the opposite directions, the protruding step 231*c* of the disc portion 231 is positioned within a range of the curved surface 233*b* of the ring portion 233 while the protruding step 233*c* of the ring portion 233 is positioned within a range of the curved surface 231*b* of the disc portion 231. As a result, as indicated by arrows shown in FIG. 4, a portion of the fluid flowing in the inlet side blade chamber 253 naturally flows toward the outlet side blade chamber 254 while simultaneously rotating in the inlet side blade chamber 253. Thus, the amount of fuel to be discharged increases.

Figure 5:
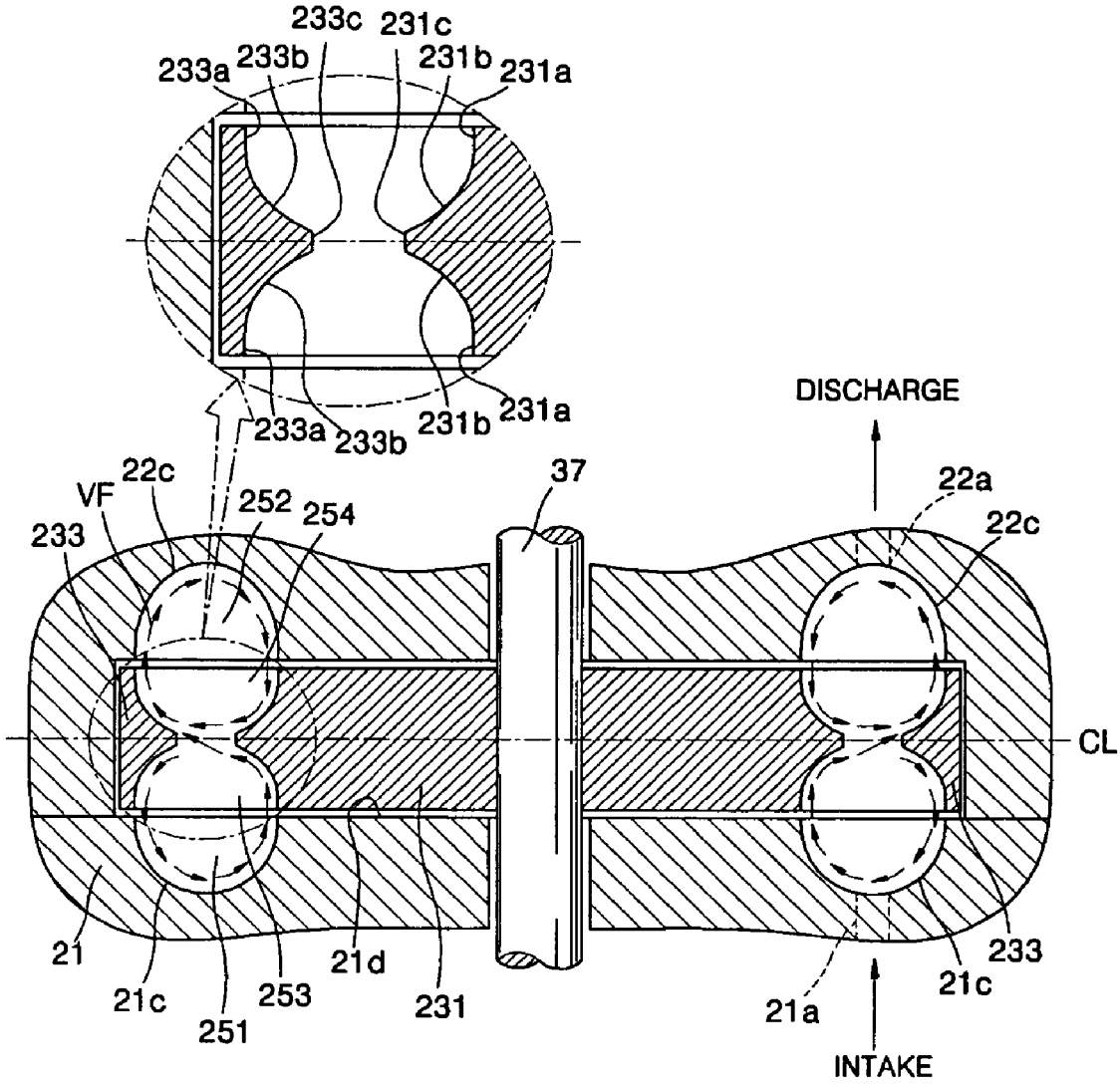
FIG. 5 is a cross-sectional view of a pump portion of a turbine type electric fuel pump for an automobile according to a third embodiment of the present invention.

FIG. 5 is a cross-sectional view of a pump portion 2 of a turbine type electric fuel pump for an automobile according to a third embodiment of the present invention. Comparing the third embodiment with the first embodiment, although the impeller 23 has the same shape, it is different that the sectional area of the inlet side ring type duct 21*c* formed in the fuel intake case 21 is designed to be smaller than the sectional area of the outlet side ring type duct 22*c* formed in the fuel discharge case 22. That is, in the third embodiment, since the volume of the inlet side transfer chamber 251 is smaller than that of the outlet side transfer chamber 252, the flow velocity of the fluid in the outlet side transfer chamber 252 having a larger volume is faster than that of the fluid in the inlet side transfer chamber 251 having a smaller volume. Accordingly, a difference in pressure between the outlet side transfer chamber 252 with a lower pressure and the inlet side transfer chamber 251 with a higher pressure increases. By improving the shape of the pump portion 2, since additional energy in transfer of the fluid from the inlet side blade chamber 253 to the outlet side blade chamber 254 can be obtained, efficiency of the fuel pump is remarkably improved compared to the existing products.

Figure 6:
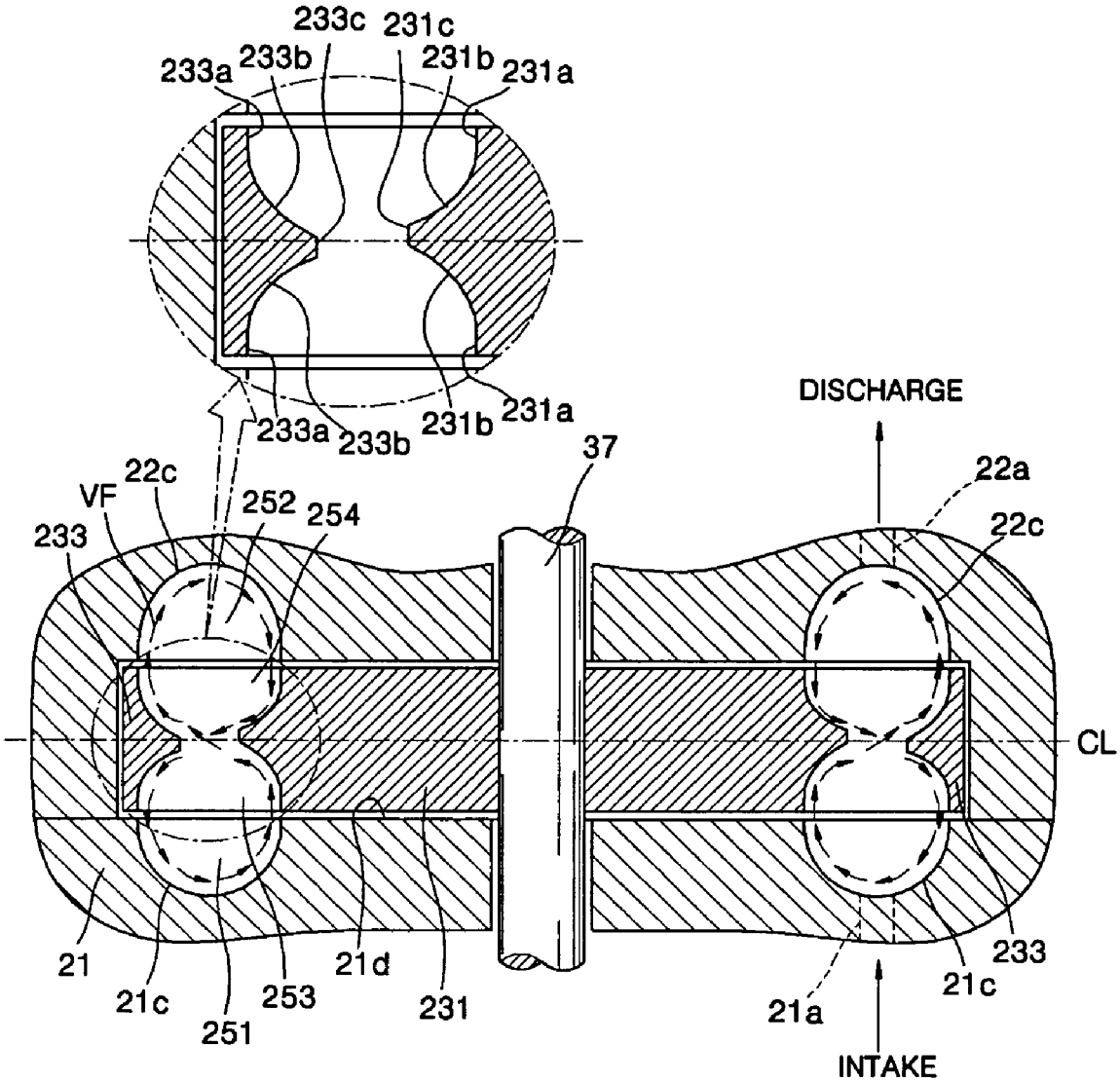
FIG. 6 is a cross-sectional view of a pump portion of a turbine type electric fuel pump for an automobile according to a fourth embodiment of the present invention.

FIG. 6 is a cross-sectional view of a pump portion 2 of a turbine type electric fuel pump for an automobile according to a fourth embodiment of the present invention, in which the second embodiment and the third embodiment are combined. That is, in the impeller 23 of FIG. 6, like the impeller 23 shown in FIG. 4, the protruding steps 231*c* and 233*c* of the disc portion 231 and the ring portion 233 are located at positions separated the same distance from the center line CL in the opposite directions with respect to the center line CL. Thus, the protruding step 231*c* of the disc portion 231 is positioned within a range of the curved surface 233*b* of the ring portion 233 while the protruding step 233*c* of the ring portion 233 is positioned within a range of the curved surface 231*b* of the disc portion 231. Also, like the embodiment shown in FIG. 5, the inlet side and outlet side transfer chambers 251 and 252 are formed such that the volume of the inlet side transfer chamber 251 is smaller than that of the outlet side transfer chamber 252.

Thus, in the fourth embodiment, since the shape of the inside of the fuel pump is designed by combining the advantageous features of the second and third embodiments, when the fluid is transferred from the inlet side blade chamber 253 to the outlet side blade chamber 254, as the volume of the outlet side blade chamber 254 increases, performance of a pump can be greatly improved.

As described above, in the turbine type electric fuel pump for an automobile according to the present invention to reduce the loss of pressure due to the collision flow inside the pump case, by hydrodynamically improving the shape of the impeller 23 and the fuel discharge case 22 and the fuel intake case 21 encompassing the impeller 23 and the forming the connection path 25, the loss of pressure due to the collision flow in the case can be reduced.

Therefore, the loss of pressure in the pump is remarkably reduced so that performance of the pump and pumping efficiency are improved. Furthermore, since a motor can be rotated at a lower r.p.m. in pumping the same amount of fuel, noise and vibration of the fuel pump are reduced so as to provide a more comfortable and quite sense of driving to passengers of an automobile. In addition, the operational life span of the fuel pump can be extended.

What is claimed is:

1. A turbine type electric fuel pump for an automobile having a casing in which a pump portion and a motor portion are installed, wherein the pump portion comprises:

a fuel intake case forming a lower end portion of the casing and having a fuel intake hole formed therein;

a fuel discharge case forming a pumping chamber by contacting an inner surface of the fuel intake case in the casing and having a fuel discharge hole formed therein; and an impeller installed on the pumping chamber, wherein an inlet side ring type duct connected to the fuel intake hole is formed on the inner surface of the fuel intake case to have a semicircular section structure, and an outlet side ring type duct connected to the fuel discharge hole is formed on an inner surface of the fuel discharge case that faces the fuel intake case to have a semicircular section structure, wherein the impeller comprises:

a disc portion in which a shaft assembly portion is formed at the center thereof;

a plurality of blades extending from an outer circumferential surface of the disc portion outwardly in a radial direction; and a ring portion connecting the blades along the outer circumferential surface of the disc portion, wherein the outer circumferential surface of the disc portion gradually protrudes outwardly in a radial direction of the impeller from both upper and lower sides thereof to a center thereof so as to form a first protruding step, and the inner circumferential surface of the ring portion gradually protrudes inwardly in a radial direction of the impeller from both upper and lower sides thereof to a center thereof so as to form a second protruding step, so that a space between the blades has a structure in which two semicircular sections, each being defined by the outer circumferential surface of the disc portion and the inner circumferential surface of the ring portion, do not overlap and are connected to each other, and wherein the first protruding step is deviated upward with respect to a center line of the impeller and the second protruding step is deviated downward with respect to the center line, whereby rotation fluid in the pump portion is smoothly moved from the fuel intake case to the fuel discharge case.

2. A turbine type electric fuel pump for an automobile having a casing in which a pump portion and a motor portion are installed, wherein the pump portion comprises:

a fuel intake case forming a lower end portion of the casing and having a fuel intake hole formed therein;

a fuel discharge case forming a pumping chamber by contacting an inner surface of the fuel intake case in the casing and having a fuel discharge hole formed therein; and an impeller installed on the pumping chamber, wherein an inlet side ring type duct connected to the fuel intake hole is formed on the inner surface of the fuel intake case to have a semicircular section structure, and an outlet side ring type duct connected to the fuel discharge hole is formed on an inner surface of the fuel discharge case that faces the fuel intake case to have a semicircular section structure, and wherein a sectional area of the inlet side ring type duct is smaller than that of the outlet side ring type duct, so that a discharge capacity at an outlet of a pump case is improved, wherein the impeller comprises:

a disc portion in which a shaft assembly portion is formed at the center thereof;

a plurality of blades extending from an outer circumferential surface of the disc portion outwardly in a radial direction; and a ring portion connecting the blades along the outer circumferential surface of the disc portion, wherein the outer circumferential surface of the disc portion gradually protrudes outwardly in a radial direction of the impeller from both upper and lower sides thereof to a center thereof so as to form a first protruding step, and the inner circumferential surface of the ring portion gradually protrudes inwardly in a radial direction of the impeller from both upper and lower sides thereof to a center thereof so as to form a second protruding step, so that a space between the blades has a structure in which two semicircular sections, each being defined by the outer circumferential surface of the disc portion and the inner circumferential surface of the ring portion, do not overlap and are connected to each other.

3. A turbine type electric fuel pump for an automobile having a casing in which a pump portion and a motor portion are installed, wherein the pump portion comprises:

a fuel intake case forming a lower end portion of the casing and having a fuel intake hole formed therein;

a fuel discharge case forming a pumping chamber by contacting an inner surface of the fuel intake case in the casing and having a fuel discharge hole formed therein; and an impeller installed on the pumping chamber, wherein an inlet side ring type duct connected to the fuel intake hole is formed on the inner surface of the fuel intake case to have a semicircular section structure, and an outlet side ring type duct connected to the fuel discharge hole is formed on an inner surface of the fuel discharge case that faces the fuel intake case to have a semicircular section structure, and wherein a sectional area of the inlet side ring type duct is smaller than that of the outlet side ring type duct so that a discharge capacity at an outlet of a pump case is improved, wherein the impeller comprises:

a disc portion in which a shaft assembly portion is formed at the center thereof;

a plurality of blades extending from an outer circumferential surface of the disc portion outwardly in a radial direction; and a ring portion connecting the blades along the outer circumferential surface of the disc portion, wherein the outer circumferential surface of the disc portion gradually protrudes outwardly in a radial direction of the impeller from both upper and lower sides thereof to a center thereof so as to form a first protruding step and the inner circumferential surface of the ring portion gradually protrudes inwardly in a radial direction of the impeller from both upper and lower sides thereof to a center thereof so as to form a second protruding step, so that a space between the blades has a structure in which two semicircular sections, each being defined by the outer circumferential surface of the disc portion and the inner circumferential surface of the ring portion, do not overlap and are connected to each other, and wherein the first protruding step is deviated upward with respect to a center line of the impeller and the second protruding step is deviated downward with respect to the center line, so that flow of fluid in the pump case is improved and a discharge capacity at an outlet of the pump case is improved.

* * * * *